United States Patent [19]

Guenther et al.

[11] Patent Number: 4,490,588

[45] Date of Patent: Dec. 25, 1984

[54] ROTARY SWITCH

[75] Inventors: Horst H. Guenther, Ansbach; Wolfgang Roesl, Heilsbronn, both of Fed. Rep. of Germany

[73] Assignee: International Standard Electric Corporation, New York, N.Y.

[21] Appl. No.: 434,952

[22] Filed: Oct. 18, 1982

[30] Foreign Application Priority Data

Oct. 20, 1981 [DE] Fed. Rep. of Germany ..... 3141550

[51] Int. Cl.[3] ..... H01H 19/00; H01H 21/00

[52] U.S. Cl. ..... 200/11 R; 200/11 DA; 200/291

[58] Field of Search ..... 200/11 R, 11 D, 11 DA, 200/11 G, 11 K, 11 J, 11 TW, 14, 291, 243, 303, 155 R, 155 A

[56] References Cited

U.S. PATENT DOCUMENTS

| | | | |
|---|---|---|---|
| 3,303,313 | 2/1967 | Okamoto | 200/14 X |
| 3,437,766 | 4/1969 | Ahrens | 200/11 K |
| 3,754,106 | 8/1973 | MacDonald | 200/11 DA X |
| 3,803,370 | 4/1974 | Garcia | 200/243 X |
| 4,246,453 | 1/1981 | Marchese et al. | 200/11 J X |

FOREIGN PATENT DOCUMENTS

| | | | |
|---|---|---|---|
| 970089 | 9/1964 | United Kingdom . | |
| 1184449 | 3/1970 | United Kingdom . | |
| 1203053 | 8/1970 | United Kingdom . | |
| 1438329 | 6/1976 | United Kingdom . | |
| 1565041 | 4/1980 | United Kingdom . | |
| 2107126 | 4/1983 | United Kingdom | 200/11 R |
| 2108320A | 5/1983 | United Kingdom | 200/11 R |

*Primary Examiner*—J. R. Scott

*Attorney, Agent, or Firm*—James B. Raden; William J. Michals

[57] ABSTRACT

A miniature multistage rotary switch having an injection-moulded metal casing and a threaded bushing moulded thereto for serving as the bearing of the switch spindle and for mounting the switch on a panel. Detent balls are supported inside a rotor and are pressed radially towards the outside against a ball-rest unit of the casing provided with detent grooves. In order to avoid the use of a lubricant the casing, within the area of the ball-rest unit, is made from a suitable plastics material and is firmly connected to the remaining metallic part of the casing.

An annular groove is formed in the switch metal casing inner surface. The groove includes a circular portion intersected by radial slots equal in number to the detent positions. The slots contain one or more locking pin members extending across the annular groove formation circular portion. A switch rotor stop cam rotates within the annular groove and abuts the locking pin member(s). The switch rotor operational range is determined by the spacing of one or more locking pin members.

13 Claims, 4 Drawing Figures

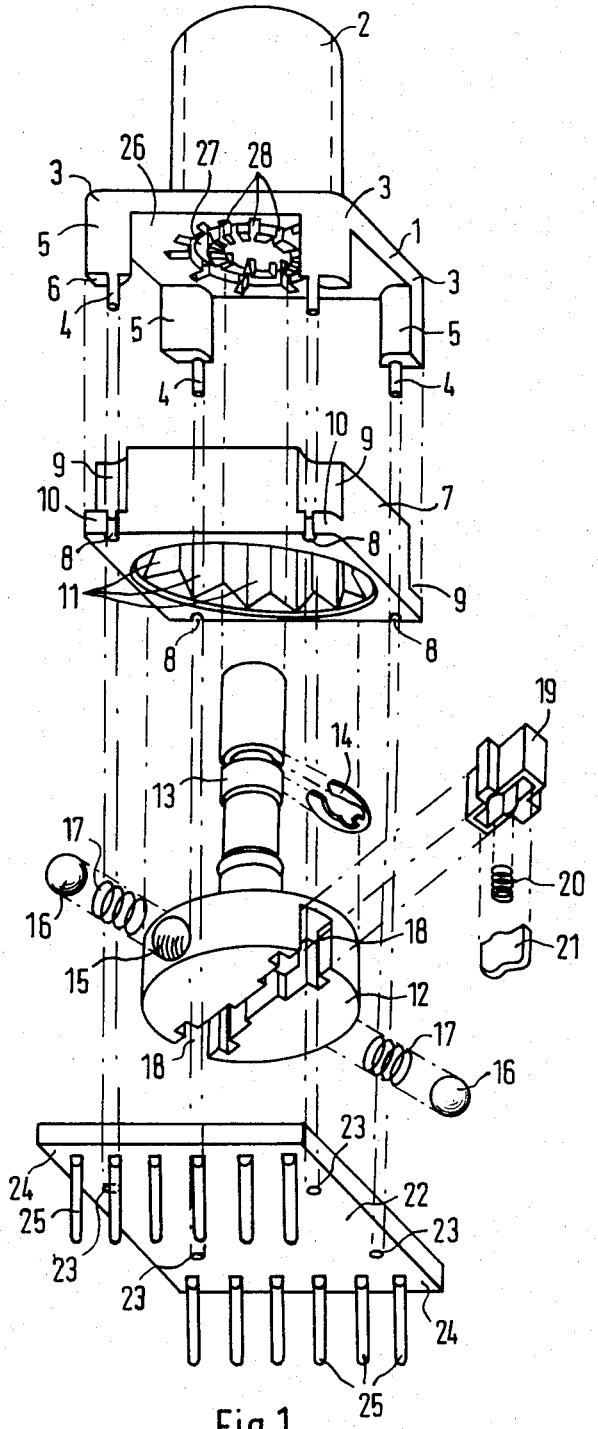
Fig.1
Fig.2
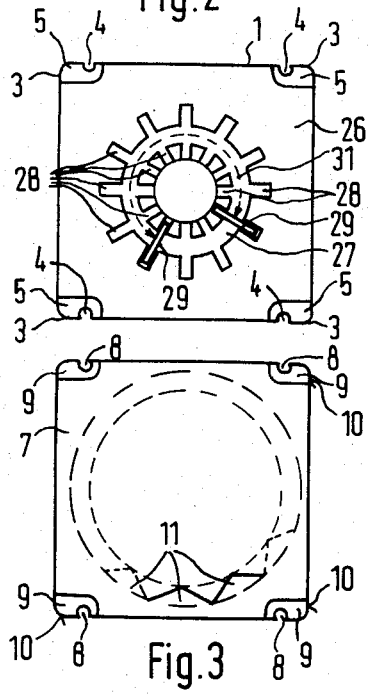
Fig.3
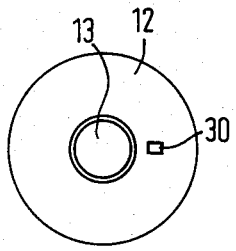
Fig.4

ROTARY SWITCH

BACKGROUND OF THE INVENTION

The present invention relates to a miniature multistage rotary switch with a metallic part of the switch casing (case member) consisting of an injection-moulded part, with a threaded bushing moulded thereto serving as the bearing of the switch spindle and for mounting the switch to a board, provided with an interior ball-rest unit co-operating with detent elements pressing radially towards the outside and arranged inside a rotor connected to the switch spindle, and which resiliently press against detent cams of the ball-rest unit.

There are miniature multistage rotary switches already known in the art whose casing together with the threaded bushing moulded thereto, are made from an injection-moulded (die-cast) zinc. On its interior side wall, the casing is provided with detent cams moulded thereto, which co-operate with spring-loaded steel balls. Such types of switches have to withstand a great number of switching cycles. For this purpose, the detent path is provided with a suitable lubricant. In spite of this, such a type of switch can only be used within a restricted temperature range, because the number of e.g. 20,000 switching cycles which are performable at room temperature, drops to about 1,000 to 2,000, and in the utmost to 5,000 at a temperature of 85° C.

Furthermore, this temperature range is restricted owing to the fact that the lubricant, at lower temperatures, has a higher viscosity, so that the switch becomes more and more difficult to turn. To this there is still to be added that the lubricant may easily enter the contact path. Of course, the contact path must likewise be slightly lubricated, but the detent lubricant is unsuitable for the use with contacts, so that by this, the service life of the contents is strongly affected.

Moreover, with respect to multistage rotary switches it is already known for the switch casing together with the threaded bushing moulded thereto, to be made from a suitable plastics material which has good anti-friction properties, i.e. a low coefficient of friction. Therefore, a separate lubrication of the detent path is not necessary. These types of switches were not found to have a reduced number of switching cycles at increased temperatures. As a disadvantage of this type of switches, however, there is considered the smaller mechanical strength, in particular of the threaded bushing. This bushing, therefore, especially at increased temperatures, cannot be loaded so strongly, so that the built-in switch is likely to become loose.

Moreover, in the case of an excessively high starting torque, the threaded bushing is likely to become deformed, so that the switch spindle no longer runs smoothly or becomes no longer rotatable at all.

It is an object of the present invention to solve the problem of designing miniature multistage rotary switches in such a way that they, by maintaining a high mechanical strength, are fully capable of performing their operational functions throughout a wide temperature range.

SUMMARY OF THE INVENTION

According to the invention, this object is achieved in that the ball-rest unit consisting of an injection- or transfer-moulded plastics part forms the wall of the casing and, with the aid of boreholes, is capable of being slipped on to rivet shanks of the metallic part of the switch casing carrying the threaded bushing and in that the projecting ends of the rivet shanks, by fixing the ball-rest unit in position, are deformed. By this measure there is obtained the mechanical strength of the prior art switches having metal casings. At the same time, it is no longer necessary to use a lubricant, thus avoiding the contact difficulties caused thereby and safeguarding the long service life of the contacts. Moreover, the operable temperature range in which the switch still shows an unobjectionable performance, is extended towards higher and lower temperatures, because in the case of high temperatures there is no longer caused a seizing (jamming) of the balls in the detent path and, in the case of very low temperatures, there is no longer caused an enlargement of the torque as the result of an increased viscosity of the lubricant. When a limit stop is used for restricting the control span (turning range), there is likewise provided the mechanical strength of the employed metal.

BRIEF DESCRIPTION OF THE DRAWINGS

Further advantageous details of the invention will now be described hereinafter with reference to an example of embodiment shown in FIGS. 1 to 4 of the accompanying drawings, in which:

FIG. 1, is a perspective exploded view from below, showing a miniature multistage rotary switch embodying the invention, FIG. 2 shows the cover as seen from below, FIG. 3 shows the ball-rest unit in a top view, and FIG. 4 shows the rotor likewise in a top view.

DETAILED DESCRIPTION

The reference numeral 1 in FIG. 1 indicates a part of the switch casing designed as a cover, upon the top part of which there is moulded a threaded bushing 2. This structural unit is made from an easily deformable metal, such as from injection-moulded zinc or transfer-moulded aluminum. Preferably, the cover 1 has a rectangular or, in particular, square outline.

Appropriately, rivet shanks 4 are moulded to the cover 1 at the corners 3 or at least within the area thereof, extending in the downward direction. Preferably, these rivet shanks 4 are designed as extensions of supporting posts 5, with the cross section transition points being designed to serve as bearing surfaces 6.

According to the invention, a ball-rest unit 7 (ball detent member) made from a high temperature resistant plastics material and having a small coefficient of friction, is capable of being plugged on to the rivet shanks 4 by means of the boreholes 8. This ball-rest unit is moreover provided with cutaway portions 9 which engage the supporting posts 5. The supporting posts 5 are smaller in height than the ball-rest unit 7, with this resulting in insulating flanges 10 which, during the assembly, come to lie on the bearing surfaces 6. This ball-rest unit 7, at the same time, forms the side wall of the miniature multistage rotary switch. The inside wall of the ball-rest unit 7 is provided with detent cams 11. As the plastics material for the ball-rest unit 7 it is appropriate to use a polyacetal, such as the material known under the trade names Delrin or Hostaform, or else a polyamide or polyurethane, etc.

Inside the ball-rest unit 7 there is arranged a rotor 12 which, with its shaft (switch spindle) 13, is pivotally mounted inside the threaded bushing 2. A spring lock washer 14 which is snapped into a recess provided for on the switch spindle 13, prevents the rotor 12 from dropping out in the downward direction. The rotor 12 is provided with two lateral boreholes 15 in each of which one ball 16 is capable of being inserted together with a compression spring 17. These balls 16 press radially in the outward direction against the detent cam path of the ball-rest unit 7 according to the invention. The boreholes 15 are appropriately arranged diagonally opposite each other. In the case of an even number of detent cams 11, both balls 16 may be inserted while in the case of an odd number of detent cams 11, only one ball 16 is inserted.

For reasons of mechanical stability, the rotor 12 is appropriately made from metal, in particular from die-cast zinc, in which the shaft 13 consisting of a harder material, such as steel, is inserted anti-rotationally and, for example, riveted thereto.

In the bottom of the rotor 12 there are provided recesses 18 in which an insulating bushing 19 is capable of being inserted. In the latter there may be inserted a compression spring 20 and, thereafter, a contact bridge 21.

The end of the casing is formed by a switching contact board 22 serving as the bottom part and preferably designed in accordance with the known printed circuit technique. This board 22 is plugged with the aid of boreholes 23 on to the rivet shanks 4 projecting over the ball-rest unit 7 and, by way of forming, e.g. by way of hot-forming of the projecting ends of the rivets, all parts are connected to form one assembly. In the course of this, the contact bridges 21 come into operative connection with the conductor leads and/or contact bosses arranged on the inside of the switching contact board 22. The conductors and/or contact bosses are in connection, at the protruding rim portions 24, with inserted contact pins 25 soldered thereto and projecting towards the outside. During the course of soldering into position the contact pins 25 points of solder are produced which must not come in touch with the metal parts of the cover 1, hence not with either the rivet shanks 4 or the supporting posts 5.

In order to avoid this, the flanges 10 on the ball-rest unit 7 are provided. In this way there is no need to provide a special insulating intermediate layer.

Both the rivet shanks 4 and the boreholes 8 in the ball-rest unit 7, as well as the boreholes 23 in the switching contact board 22 are appropriately arranged either symmetrically or asymmetrically in such a way that the switching contact board 22 and, if so required, also the ball-rest unit 7 can be secured either only in one single position or in two positions turned in relation to one another by 180°. In one preferred embodiment of the invention, both the supporting posts 5 and the rivet shanks 4 extend to the outside wall, and the boreholes 8 and the cutaway portions 9 of the ball-rest unit 7 are designed as laterally open recesses. This permits the overall dimensions of the miniature multistage rotary switch to be kept particularly small.

Another suitable further embodiment of the subject matter of the invention resides in providing an annular groove 27 on the inside 26 of the cover, which is crossed by a number of radially extending slots 28 corresponding to the number of detent cams 11. In one or two of the slots 28, a locking pin 29 may be inserted which crosses the annular groove 27 and which may co-operate with a stop cam 30 of the rotor 12, running in the annular groove 27. Quite depending on whether one or two such locking pins 29 are inserted, the angular setting of the rotor 12 and also of the switch spindle 13 can be restricted and moreover, quite depending on where the locking pins 29 are inserted, the control span 31 may start and end at any suitable points.

It is of particular advantage that with the subject matter of the invention, by simply replacing the ball-rest unit 7 having a defined number of detent cams 11, by another type of ball-rest unit 7 having a number of detent cams 11 differing from the first one, the remaining parts of the switch, of course by interchanging and correspondingly replacing the switching contact board 22, can be built up for any arbitrary number and/or angular degrees of the detent positions, as well as two or multi-polar switches.

If, in addition thereto, there is supposed to be provided a restriction of the angle-of-rotation span, then the number of slots 28 on the inside 26 of the cover will have to be changed, with a certain number being sufficient for various numbers of detents. For example, if twelve slots 28 are provided, it is possible to provide a ball-rest unit 7 having two to twelve detent cams 11, with the angular spacing thereof, quite depending on the number of detent cams 11, amounting to one to six times the angular spacing of the slots 28. With respect to other angular spacings of the detents and the possibility of fixing the control span, the angular spacing of the slots 28 will have to be chosen accordingly.

What is claimed is:

1. An improved miniature mulitstage rotary switch in which a metallic part of the switch casing comprises a molded part having a threaded bushing molded thereto, said bushing serving as a bearing of the switch spindle and for mounting the switch to a board or panel, and provided with an interior ball-rest unit having at least one detent ball disposed within a rotor connected to the switch spindle, said detent ball biased radially outwardly against and cooperating with a plurality of detent elements disposed on the inner peripheral surface of said ball-rest unit, the improvement comprising: said ball-rest unit being formed of a molded plastic, said ball-rest unit forming a wall of said switch casing and having a plurality of openings which are adapted to receive therein a like number of rivet shanks depending from said switch casing metallic part so as to secure said metallic part of said switch casing to said ball-rest unit when the projecting ends of said rivet shanks are deformed.

2. The miniature multistage rotary switch of claim 1, wherein said ball-rest unit forms the side walls of said switch casing, and further including a switch contact board having a plurality of openings corresponding to said ball-rest unit openings and which are adapted to receive said metallic switch casing part rivet shanks therein, said rivet shanks engaging said switch contact board openings and holding said ball-rest unit between said switch contact board and said metallic switch casing part, said switch contact board engaging a plurality of contact elements supported in said switch rotor, said contact elements being biased into engagement with said contact board.

3. The miniature multistage rotary switch of claim 1 wherein said switch casing has either a square or rectangular configuration and said rivet shanks extend from a plurality of supporting posts located within the corners of said switch casing metallic part, said ball-rest unit including a plurality of recesses, said recesses corresponding to and complementing the cross-sections of said supporting posts, said recesses further receiving said rivet shanks therein, whereby an insulating flange is formed at the bearing surface of each recess and supporting post.

4. The miniature multistage rotary switch of claim 3, wherein said ball-rest unit recesses are open to the exterior of said ball-rest unit and wherein said ball-rest unit openings extend through said ball-rest unit.

5. The miniature multistage rotary switch of claim 2, wherein said switch contact board includes a printed circuit board having rim portions projecting over said ball-rest unit, said switch contact board further including a plurality of contact pins, said contact pins being soldered to a plurality of corresponding contacts or contact paths on the side of said switch contact board facing said ball-rest unit, said ball-rest unit insulating flanges preventing said switch casing metallic part supporting posts from contacting said switch contact board pins or soldering points thereof.

6. The miniature multistage rotary switch of claim 2, wherein said rivet shanks and said ball-rest unit openings are asymmetrically arranged, whereby said switch contact board is capable of being assembled onto said rivet shanks only in one single position or in two positions staggered 180° in relation to each other.

7. The miniature multistage rotary switch of claim 2, wherein said ball-rest unit includes a plurality of detent cams along the periphery of its inner wall and said switch casing metallic part includes an annular groove formed in the inside surface of said switch casing metallic part for limiting the turning range of said switch rotor, said switch rotor having a stop cam located thereupon, said stop cam being received by and rotatable in said annular groove, said annular groove including a plurality radially slots arranged generally perpendicular to said annular groove said slots corresponding to the number of said detent cams of said ball-rest unit, said slots being adapted to receive at least one locking pin member crossing said annular groove to engage said switch rotor stop cam to limit the operational movement of said switch rotor.

8. A miniature multistage rotary switch comprising: a molded metallic casing and a bushing molded integrally thereto, said bushing providing a bearing for the switch spindle; a molded plastic ball-rest unit having an inner wall defining a cavity centrally disposed therein and a plurality of inwardly extending detent elements disposed about the periphery of said inner wall, said ball-rest unit further including a plurality of openings adapted to receive therein a corresponding number of rivet shanks extending from said metallic switch casing; a switch rotor disposed within said switch casing, said switch rotor including at least one detent ball biased radially outwardly so as to engage and cooperate with said detent elements; and a switch contact board having a plurality of openings also adapted to receive said switch casing rivet shanks therein, said switch contact board holding said plastic ball-rest unit in abutting engagement between said metallic switch casing and said contact board.

9. A switch as claimed in claim 8 wherein said ball-rest unit forms the side walls of said switch casing.

10. A switch as claimed in claim 8, wherein said switch casing is generally square or rectangular in outer configuration and includes a plurality of supporting posts generally disposed within the corners of said switch casing, said rivet shanks extending from said supporting posts and said ball-rest unit includes a plurality of recesses adapted to receive said supporting post therein, said recesses being disposed generally within the corners of said ball-rest unit, said recesses extending partially through the thickness of said ball-rest unit and terminating in a plurality of bearing surfaces, the cross-section of said recesses complementing the cross-section of said supporting posts, whereby insulating flanges are formed between said supporting posts and said switch contact board.

11. A switch as claimed in claim 8 wherein said contact board includes a printed circuit having plurality of contacts thereon, said contacts being connected, on the side of said contact board that faces said ball-rest unit, to a plurality of contact pins protruding in an opposite direction from said ball-rest unit, said ball-rest unit insulating flanges preventing the connection points of said contact pins from touching said supporting posts or said metallic switch casing.

12. A switch as claimed in claim 11, wherein said switch casing rivet shanks and said ball-rest unit openings are arranged such that said switch contact board can be assembled to said ball-rest unit to receive said rivet shanks in only two positions, each position rotated 180° from the other position.

13. A switch casing as claimed in claim 8, wherein said metallic switch casing further includes on the switch casing surface facing said ball-rest unit an annular groove adapted to receive a stop cam therein, and a plurality of slots extending radially in relation to said ball-rest unit detent elements and arranged approximately perpendicular to said groove, said slots being adapted to receive at least one locking pin therein which engages a stop cam of said switch rotor rotatable in said annular groove, whereby the turning movement of said switch rotor is limited.

* * * * *